US010154704B1

(12) United States Patent
Caito, III

(10) Patent No.: US 10,154,704 B1
(45) Date of Patent: Dec. 18, 2018

(54) HELMET SLIDE ASSEMBLY

(71) Applicant: John Caito, III, Rehoboth, MA (US)

(72) Inventor: John Caito, III, Rehoboth, MA (US)

(73) Assignee: Desmark Industries, Inc., Cranston, RI (US)

( * ) Notice: Subject to any disclaimer, the term of this patent is extended or adjusted under 35 U.S.C. 154(b) by 428 days.

(21) Appl. No.: 15/091,836

(22) Filed: Apr. 6, 2016

Related U.S. Application Data

(60) Provisional application No. 62/148,995, filed on Apr. 17, 2015.

(51) Int. Cl.
*A42B 3/22* (2006.01)

(52) U.S. Cl.
CPC ..... *A42B 3/223* (2013.01)

(58) Field of Classification Search
CPC ..... A42B 3/22; A42B 3/221; A42B 3/222; A42B 3/223; Y10T 24/4016; Y10T 24/2142; Y10T 24/2183; Y10T 24/2185
USPC ..... 2/424, 425, 421, 410, 6.3, 6.5
See application file for complete search history.

(56) References Cited

U.S. PATENT DOCUMENTS 3,047,876 A * 8/1962 Malcom, Jr. ..... A42B 3/145 2/9
4,042,974 A * 8/1977 Morgan ..... A42B 3/326 2/424
4,110,847 A * 9/1978 Dera ..... A42B 3/08 2/421
4,242,757 A * 1/1981 Nava ..... A42B 3/222 2/10
4,247,960 A * 2/1981 Nava ..... A42B 3/222 2/424
4,297,747 A * 11/1981 Nava ..... A42B 3/224 2/424
4,312,078 A * 1/1982 Pollitt ..... A42B 3/222 16/348
4,397,047 A * 8/1983 Nava ..... A42B 3/222 2/424
4,539,715 A * 9/1985 Clement ..... A44B 11/12 2/420
4,612,675 A * 9/1986 Broersma ..... A42B 3/12 2/171.3
4,769,857 A * 9/1988 Cianfanelli ..... A42B 3/326 2/421
4,802,243 A * 2/1989 Griffiths ..... A61F 9/025 2/422
4,807,305 A * 2/1989 Sundahl ..... A42B 3/223 2/424
5,062,162 A * 11/1991 Kamata ..... A42B 3/222 2/424

(Continued)

*Primary Examiner* — Clinton T. Ostrup
*Assistant Examiner* — James Heracklis
(74) *Attorney, Agent, or Firm* — Salter & Michaelson

(57) ABSTRACT

A helmet slide assembly is attached to a helmet and functioning to enable a tilting of a visor relative to the helmet. The helmet assembly includes a base plate that is attached to a sidewall of the helmet and a slide plate disposed substantially in a parallel arrangement relative to the base plate and secured to a sidewall of the visor. The slide plate has an elongated slot for receiving a pivot member. The assembly also includes a pivot plate having locked and unlocked positions. The pivot member is secured at one end thereof to the pivot plate and the slide plate is constructed and arranged for a sliding motion once the pivot plate is unlocked.

12 Claims, 14 Drawing Sheets

(56) References Cited

U.S. PATENT DOCUMENTS 5,078,130 A * 1/1992 Van Oosten ..... A62B 18/04 128/201.24
5,131,101 A * 7/1992 Chin ..... A42B 3/226 2/424
5,182,816 A * 2/1993 Arai ..... A42B 3/222 2/424
5,278,999 A * 1/1994 Brown ..... A61F 9/025 2/10
5,373,583 A * 12/1994 Birum ..... A42B 1/247 2/10
5,383,258 A * 1/1995 Nicoletti ..... A43C 11/1406 24/68 SK
5,412,814 A * 5/1995 Pernicka ..... A42B 3/20 2/424
5,467,508 A * 11/1995 Feng ..... A44B 11/06 24/170
5,483,699 A * 1/1996 Pernicka ..... A42B 3/22 2/424
5,661,877 A * 9/1997 Bloomer ..... A44B 11/12 24/170
5,687,427 A * 11/1997 Lamattina ..... A42B 3/221 2/424
5,787,513 A * 8/1998 Sharmat ..... A42B 3/328 2/411
5,806,145 A * 9/1998 Chen ..... A44B 11/14 24/170
5,890,233 A * 4/1999 Kaffka ..... A42B 3/226 2/10
5,901,369 A * 5/1999 Pilney ..... A42B 3/22 2/422
5,987,651 A * 11/1999 Tanaka ..... A42B 3/223 2/424
6,047,409 A * 4/2000 Simpson ..... A42B 3/223 2/424
6,226,803 B1 * 5/2001 Tanaka ..... A42B 3/326 2/424
6,253,386 B1 * 7/2001 Gafforio ..... A42B 3/222 2/424
6,442,766 B1 * 9/2002 Arai ..... A42B 3/222 2/422
6,467,133 B1 * 10/2002 Chen ..... A43C 11/1433 24/68 SK
6,845,548 B1 * 1/2005 Lin ..... A42B 3/185 2/10
7,020,901 B2 * 4/2006 Brhel ..... A61F 11/14 2/209
7,376,981 B2 * 5/2008 Shida ..... A42B 3/326 2/424
7,634,820 B2 * 12/2009 Rogers ..... A42B 3/324 2/410
7,681,257 B1 * 3/2010 Broersma ..... A42B 3/20 2/425
7,805,776 B2 * 10/2010 Crossman ..... A42B 3/044 2/410
7,895,678 B2 * 3/2011 Tews ..... A42B 3/24 2/424
7,975,318 B2 * 7/2011 Zuber ..... A42B 3/145 2/410
8,028,349 B2 * 10/2011 Petzl ..... A42B 3/14 2/410
8,032,946 B2 * 10/2011 Ishikawa ..... A42B 3/26 2/410
8,051,500 B2 * 11/2011 Lee ..... A42B 3/226 2/10
8,056,152 B2 * 11/2011 Brace ..... A42B 3/225 2/410
8,166,575 B2 * 5/2012 Haselmayer ..... A42B 3/166 2/10
8,176,574 B2 * 5/2012 Bryant ..... A42B 3/328 2/410
8,206,327 B2 * 6/2012 Wu ..... A61H 7/006 2/171
8,458,822 B2 * 6/2013 Lee ..... A42B 3/223 2/422
8,732,864 B2 * 5/2014 Fountain ..... A61F 11/14 2/209
8,739,318 B2 * 6/2014 Durocher ..... A42B 3/125 2/417
8,813,270 B2 * 8/2014 Pizzi ..... A42B 3/223 2/425
9,125,447 B2 * 9/2015 Lebel ..... A42B 3/185
2002/0062517 A1 * 5/2002 Gafforio ..... A42B 3/222 2/424
2002/0100145 A1 * 8/2002 Kim ..... A44B 11/14 24/191
2002/0189005 A1 * 12/2002 Taniuchi ..... A42B 3/223 2/424
2003/0229934 A1 * 12/2003 Gafforio ..... A42B 3/222 2/424
2004/0019956 A1 * 2/2004 Arai ..... A42B 3/222 2/410
2007/0079429 A1 * 4/2007 Pilon ..... A42B 3/324 2/410
2008/0216215 A1 * 9/2008 Lee ..... A42B 3/326 2/424
2009/0070908 A1 * 3/2009 Gafforio ..... A42B 3/226 2/15
2009/0144872 A1 * 6/2009 Lebel ..... A42B 3/221 2/6.7
2010/0050326 A1 * 3/2010 Lee ..... A42B 3/222 2/422
2010/0132096 A1 * 6/2010 Chen ..... A42B 3/226 2/425
2011/0302701 A1 * 12/2011 Kuo ..... A42B 3/222 2/421
2012/0185989 A1 * 7/2012 Higgins ..... A42B 3/185 2/15
2013/0025033 A1 * 1/2013 Durocher ..... A42B 3/324 2/417
2013/0031702 A1 * 2/2013 Gafforio ..... A42B 3/08 2/421
2013/0182414 A1 * 7/2013 Fedewa ..... A42B 3/0446 362/106
2014/0143937 A1 * 5/2014 Cram ..... A42B 3/32 2/410
2014/0352020 A1 * 12/2014 Isobe ..... A42B 3/223 2/9
2016/0015114 A1 * 1/2016 Berthier ..... A42B 3/222 2/424

* cited by examiner

HELMET SLIDE ASSEMBLY

RELATED CASES

Priority for this application is hereby claimed under 35 U.S.C. § 119(e) to commonly owned and co-pending U.S. Provisional Patent Application No. 62/148,995 which was filed on Apr. 17, 2015 and which is incorporated by reference herein in its entirety.

FIELD OF THE INVENTION

The present invention relates in general to a slide assembly for use with a helmet. More particularly, the slide assembly disclosed herein is for use with a combative helmet.

BACKGROUND AND SUMMARY OF THE INVENTION

There are various helmet constructions that exist including a visor arrangement associated with the helmet. However, in existing helmet constructions there is no effective device by which the visor of the helmet can be readily moved between open and closed positions.

Accordingly, an object of the present invention is to provide an improved helmet construction, particularly wherein a visor of the helmet can be easily pivoted between open and closed positions.

Another object of the present invention to provide a slide assembly for a helmet, particularly for a combative helmet and in which the slide assembly allows, not only a pivoting action of the visor, but also a forward translation of the visor for pivoting purposes.

In accordance with the present invention there is provided a helmet slide assembly insert attached to a helmet and functioning to enable a tilting of a visor relative to the helmet, said helmet assembly comprising; a base plate that is attached to a sidewall of the helmet; a slide plate disposed substantially in a parallel arrangement relative to the base plate and secured to a sidewall of the visor; said slide plate having an elongated slot; a pivot plate having locked and unlocked positions; and a pivot member secured at one end thereof to the pivot plate; said slide plate constructed and arranged for a sliding motion once the pivot plate is unlocked.

In accordance with other aspects of the present invention, an opposite end of the pivot plate has a latch for engagement with the base plate; the base plate and the slide plate have respective interlocking surfaces and the interlocking surfaces may be a sawtooth surface.

In accordance with the present invention there is provided a helmet slide assembly attached to a helmet and functioning to enable a tilting of a visor relative to the helmet, said helmet assembly comprising; a base plate that is attached to a sidewall of the helmet; a slide plate disposed adjacent to the base plate, secured to a sidewall of the visor and having an elongated slot; a pivot plate disposed adjacent to the slide plate and remote from the base plate and having locked and unlocked positions; and a pivot pin secured at one end thereof to the pivot plate, passing through the elongated slot in the slide plate and engaged with the base plate; said slide plate constructed and arranged for a sliding motion once the pivot plate is unlocked.

In accordance with other aspects of the present invention an opposite end of the pivot plate has a latch for engagement with the base plate in the locked position of the pivot plate; the base plate and slide plate have respective facing interlocking surfaces; the interlocking surfaces may be a sawtooth surface; the pivot pin comprises a first pivot pin and further including a second pivot pin for pivotally securing the first pivot pin to the pivot plate and that extends through a head of the first pivot pin, said pivot plate, in its locked position, extending substantially parallel to the slide plate, and, in its unlocked position extending substantially orthogonal to the slide plate; the base plate also has a hole therein for accommodating and end of the first pivot pin; the pivot plate has an opposed end that carries a releasable latch, and the base plate has a tang that is engagable with the latch in the locked position of the pivot plate; the slide plate has an engaged position wherein the base plate and slide plate respective interlocking surfaces are interlocked, and disengaged position wherein the slide plate is transitioned lateral to the base; the elongated slot in the slide plate allows the slide plate to transition in a direction so that the visor moves away from the helmet, both the slide plate and base plate are substantially planar extending in a longitudinal direction, the slide plate moving in the longitudinal direction to a position wherein the pivot plate can then be pivoted to hold the visor in a forward position; and the base plate has opposed end securing means for securing the base plate to the helmet, and a centre section that includes a sawtooth engagement section that partially extends longitudinally; the slide plate has at least one hole for receiving a fastener for securing the slide plate with the visor, and a sawtooth section adjacent to the elongated slot and engageable with the sawtooth section of the base plate in the locked position; and the pivot plate has a pair of end arms, each with a hole, for receiving the second pin.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
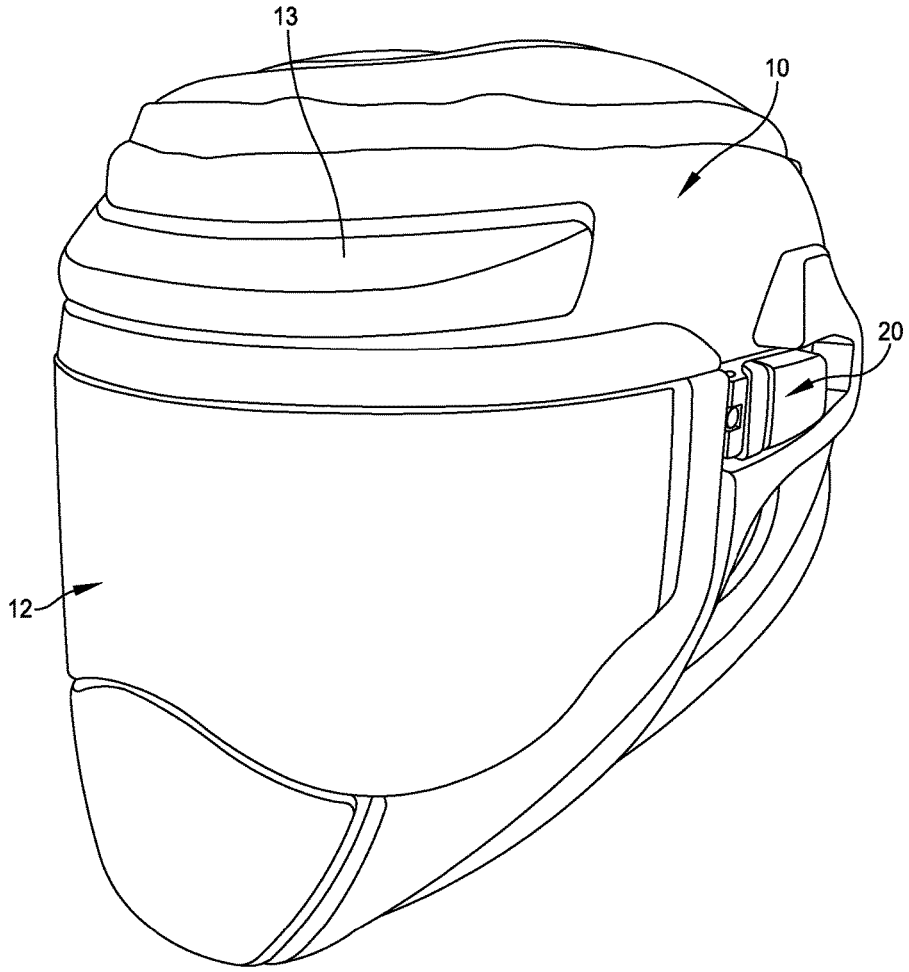
FIG. 1 is a perspective view of a combative helmet and visor showing the slide assembly of the present invention, with there being a slide assembly on both sides of the visor.
Figure 2:
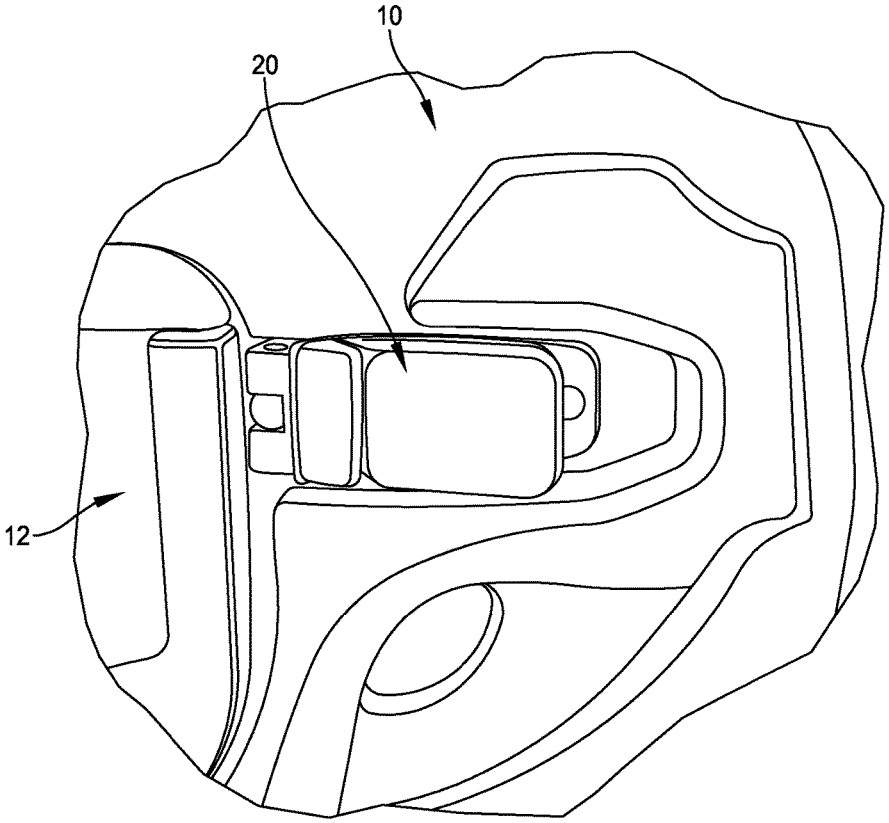
FIG. 2 is an enlarged fragmentary view showing the slide assembly in the same position as depicted in FIG. 1.

Reference is now made to several views of the drawings in FIGS. 1-15 to show an embodiment of the combative helmet of the present invention. The basic helmet construction is shown at 10 and a visor is shown at 12. Typically, part of the helmet construction includes a padded rim 13 illustrated in FIG. 1. FIG. 1 also illustrates the slide assembly at 20. Although not illustrated in the drawings, there is a like mirror image slide assembly 20 on the opposite side of the visor so that the same pivoting action can occur on both sides of the visor.

Figure 3:
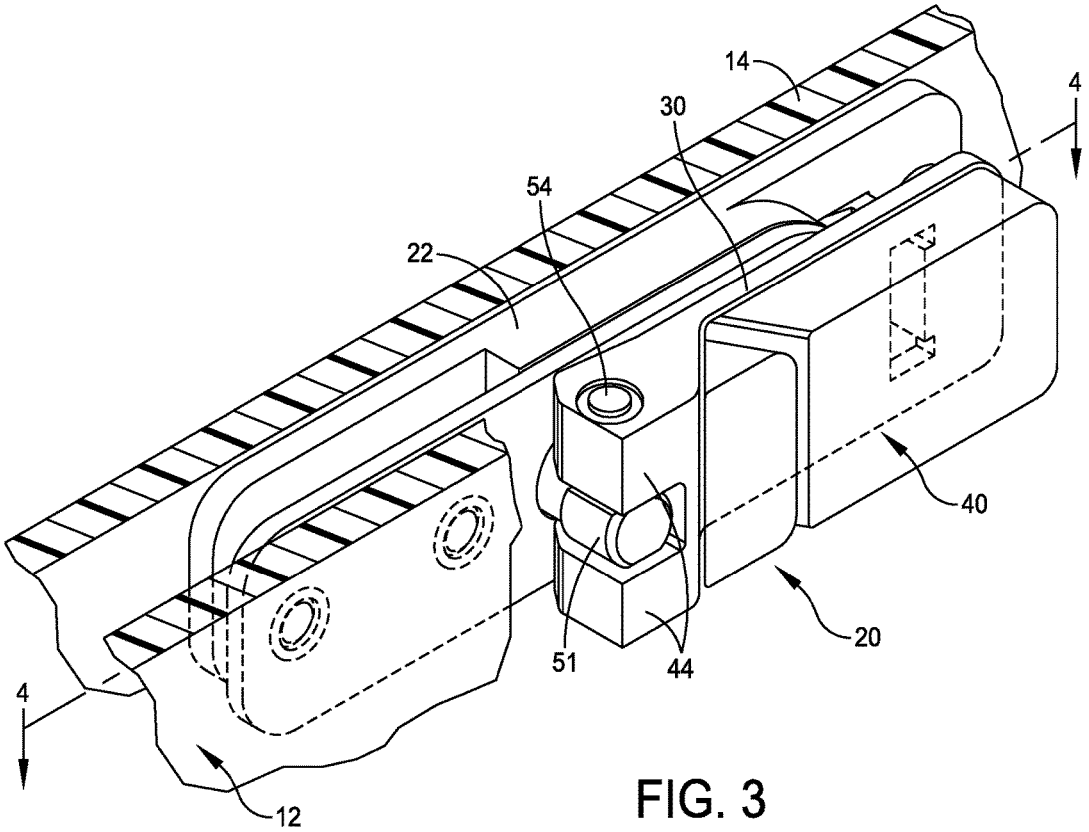
FIG. 3 is a fragmentary perspective view showing further details of the slide assembly in the position of FIG. 1.
Figure 12:
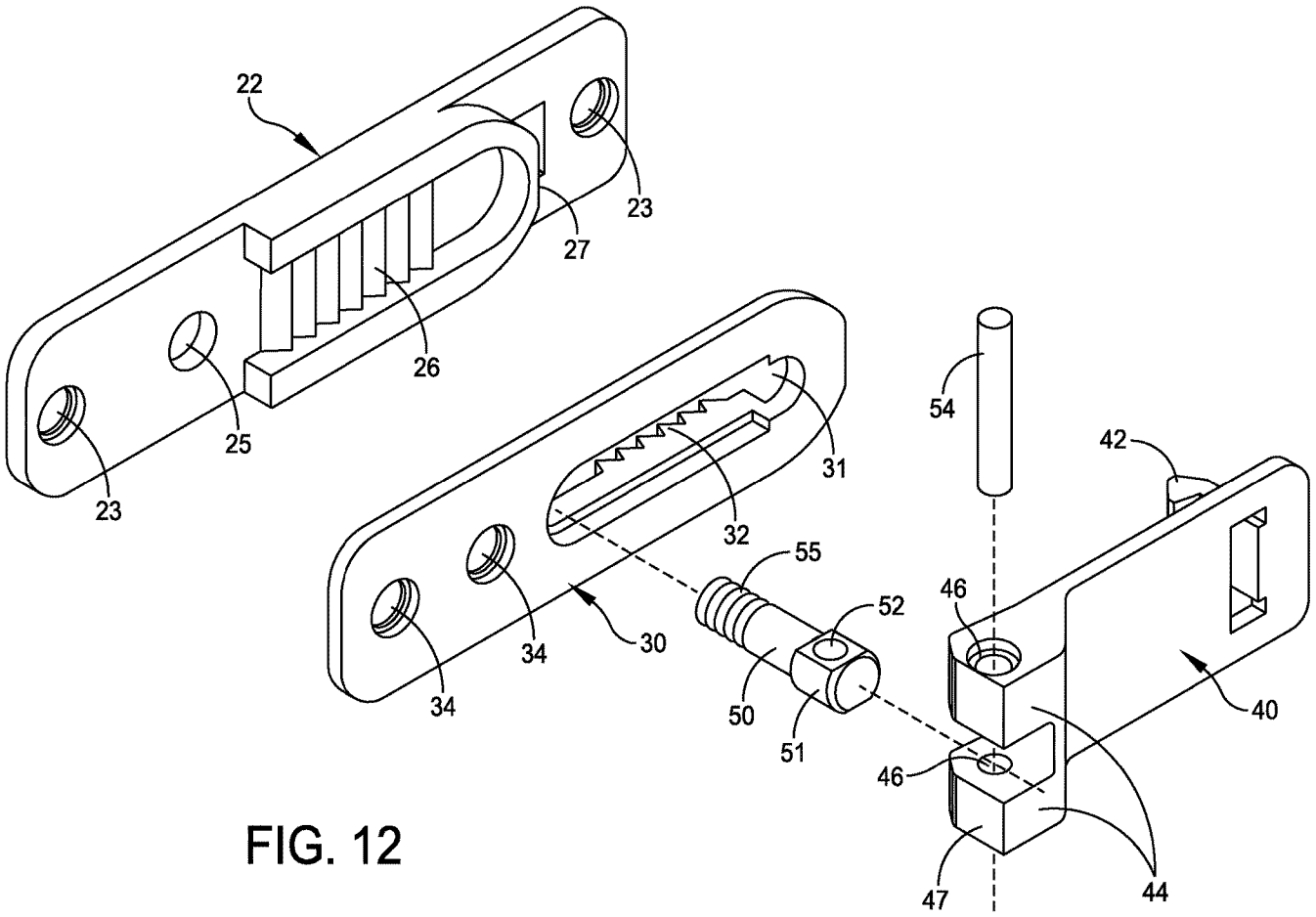
FIG. 12 is an exploded perspective view of the components comprising the slide assembly.

The fragmentary perspective view of FIG. 3 illustrates the slide assembly 20 in what may be considered a locked position. Reference can also now be made to FIG. 12 which shows the basic components of the slide assembly 20. This slide assembly 20 includes a main base plate 22 that is secured to the helmet. This is illustrated in FIG. 3 secured to a wall 14 of the helmet 10. The base plate 22 has end internally threaded holes 23, a sawtooth interlock surface 26, a hole 25 for accommodating screw 50 and a tang 27 (see also FIGS. 4 and 5). The slide assembly also includes the slide plate 30 which includes an elongated slot 31 for receiving the screw 50 and a sawtooth surface 32. The slide plate 30 is also provided with internally threaded holes 34. In FIG. 12 a third main component is the pivot plate 40. The screw 50 is secured to the pivot plate 40 by means of a pin 54. The screw 50 has a threaded end at 55 and a head 51 with a hole 52 extending therethrough. The pin 54 is for accommodation in a set of holes 46 in respective arms 44 of the pivot plate 40. The pin 54 is positioned through the holes 46 and provides a pivot point for the pin 50.

Figure 4:
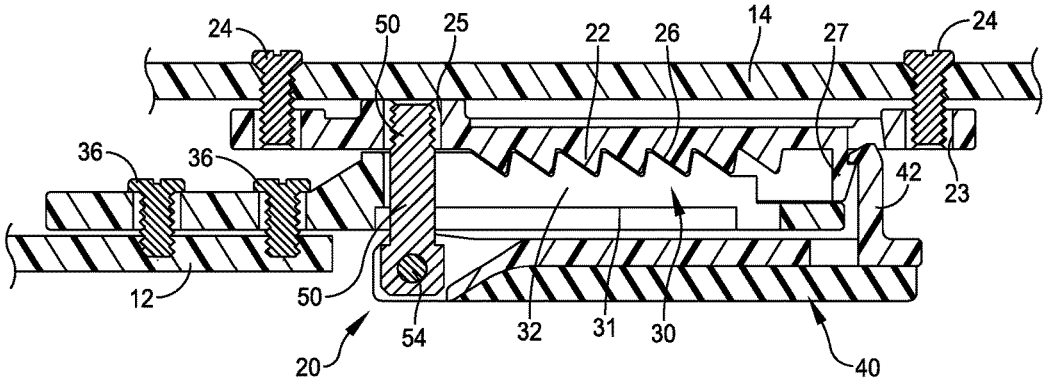
FIG. 4 is a partial cross-sectional view taken along line 4-4 of FIG. 3 with the slide assembly still in a locked position.
Figure 5:
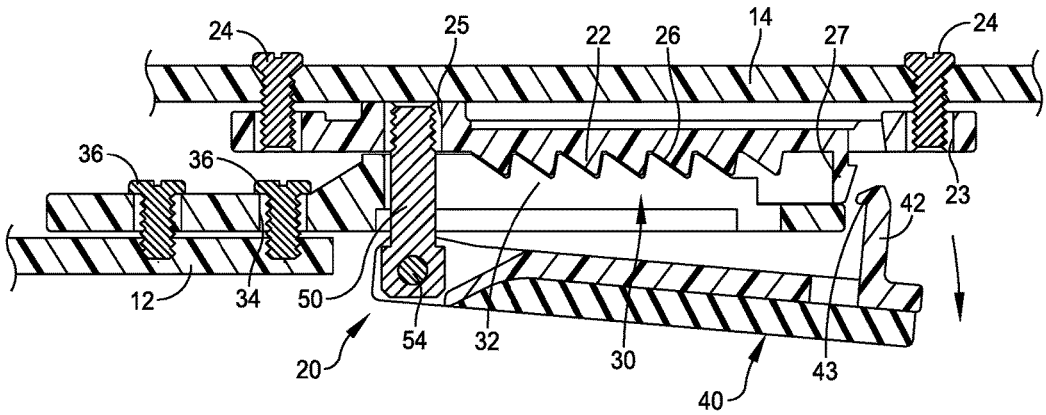
FIG. 5 is a partial cross-sectional view similar to that shown in FIG. 4 with the pivot plate initially disengaged from the base plate.

FIGS. 4 and 5 illustrate main base plate 22 secured to the helmet wall 14. This securing of the base plate 22 firmly holds the base plate against the wall 14 by means of screws 24. FIGS. 4 and 5 also illustrate the screws 36 used for attachment of the slide plate 30 with the visor 12. As also illustrated in FIGS. 4, 5 and 12, there is another through hole 25 that accommodates the screw 50 that is free-floating within the hole 25. The hole 25 may be un-threaded. The base plate 22 also includes an end tang 27. In FIG. 4 this end tang 27 is shown engaged by the latch 42 at the end hook 43. FIG. 4 shows the engaged position, while FIG. 5 illustrates the latch 42 having been disengaged from the tang 27. This enables a pivoting of the pivot plate 40. This pivoting is illustrated in an initial position in FIG. 5, and is generally about the axis of the pin 50.

Figure 6:
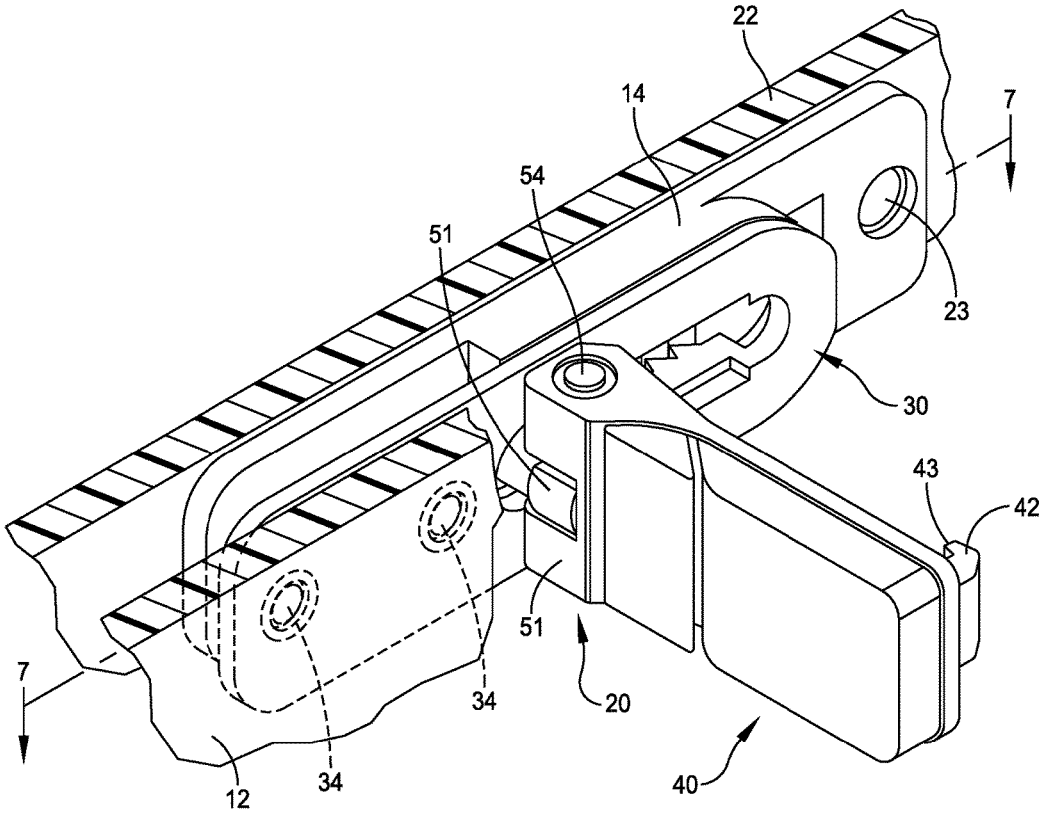
FIG. 6 is a fragmentary perspective view similar to that shown in FIG. 3 but with the pivot plate pivoted to a position essentially orthogonal or transverse to the base plate.
Figure 7:
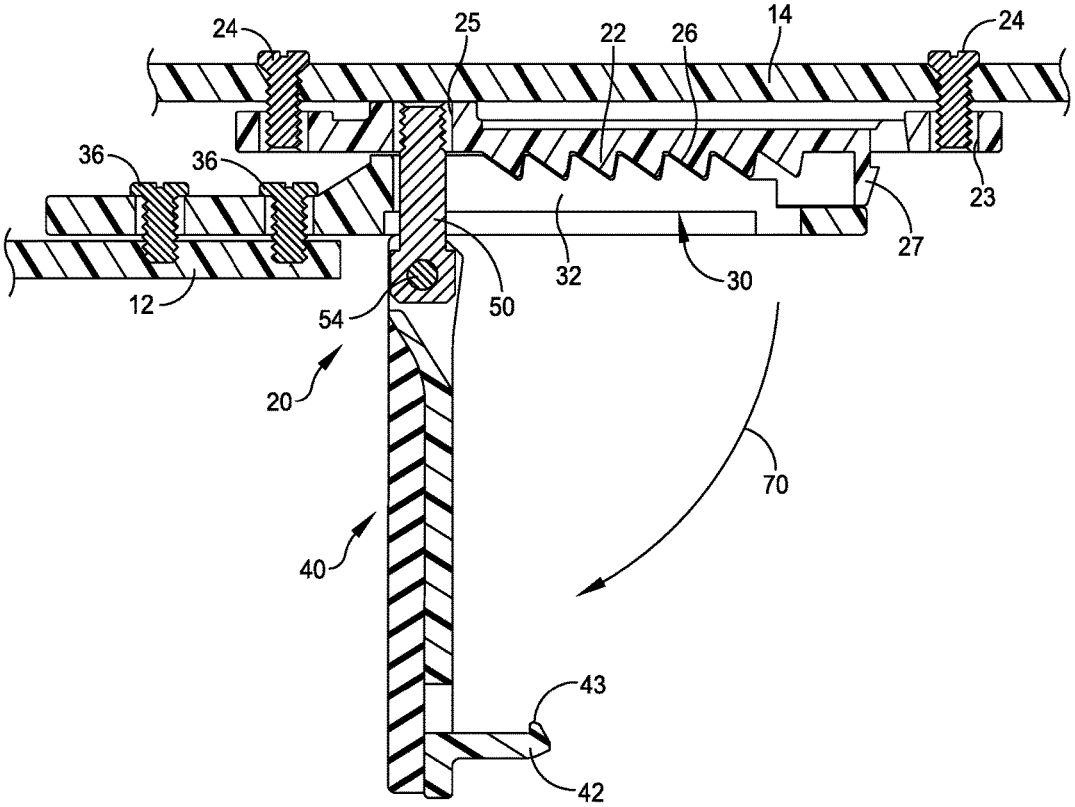
FIG. 7 is a partial cross-sectional view taken along line 7-7 of FIG. 6.

Reference is now made to FIGS. 6-10 which show the following operation that enables the visor to be moved forwardly and pivoted upwardly. In this regard, FIGS. 6 and 7 illustrate a relationship between base plate 22 and the slide plate 30 that is interlocked. In that regard, the respective sawtooth surfaces 26 and 32 are shown interlocked in FIG. 7. FIG. 7 also illustrates by arrow 70 the pivoting of the pivot plate 40 to a position substantially orthogonal to the base plate 22. In the position of FIG. 7, the screw 50 is engaged within the hole 25 of the base plate 22.

Figure 8:
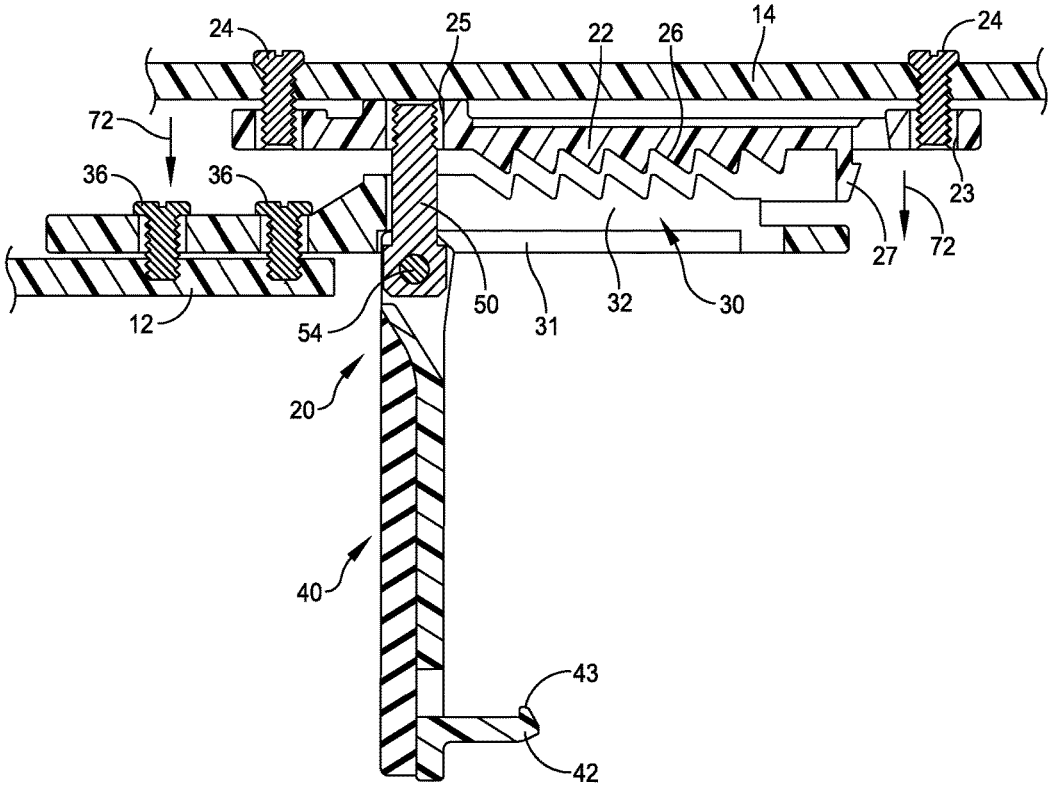
FIG. 8 is a partial cross-sectional view similar to that shown in FIG. 7 with the slide plate and pivot plate moved away from the base plate.
Figure 9:
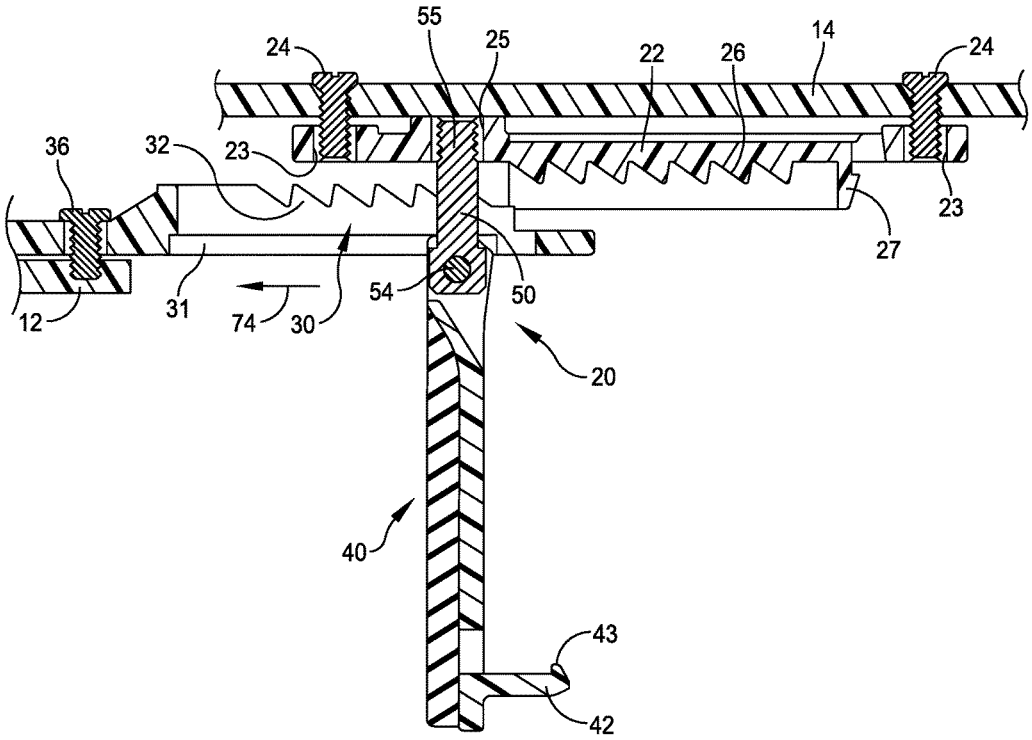
FIG. 9 is a partial cross-sectional view illustrating the slide plate having been moved to disengage with the base plate.
Figure 10:
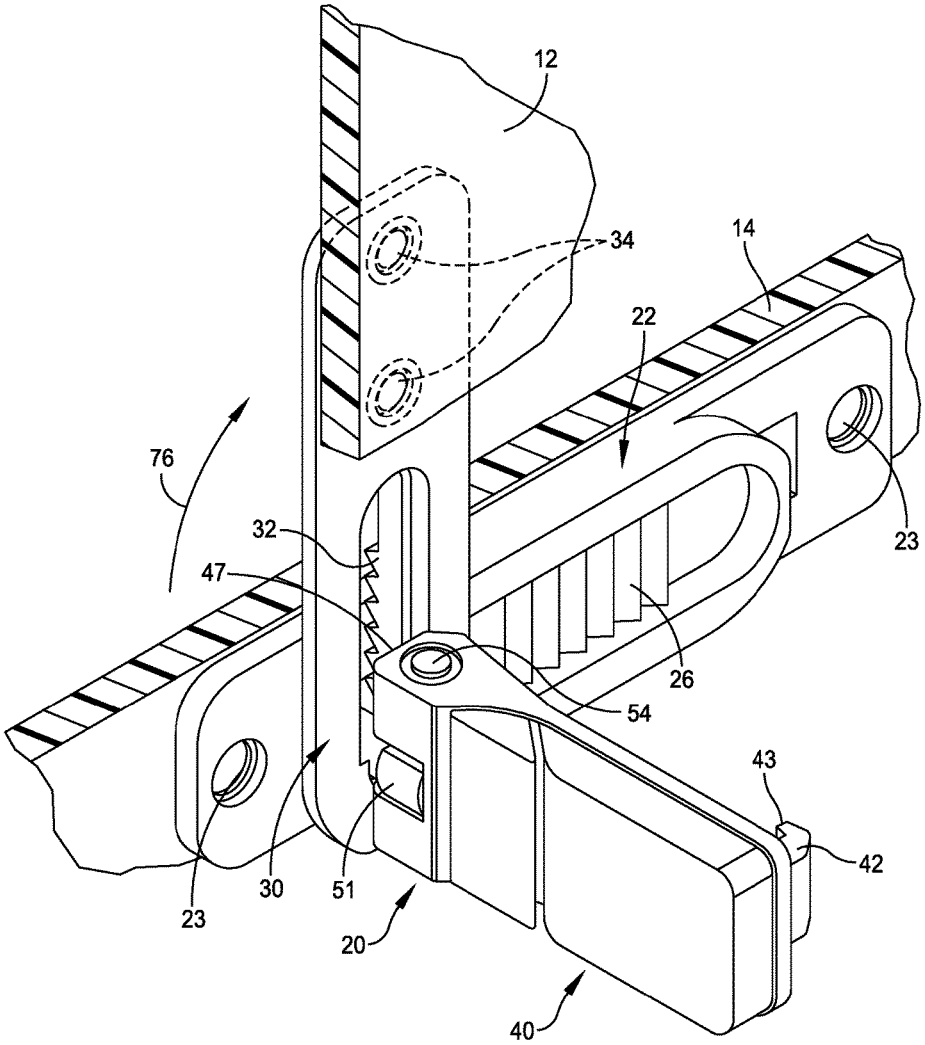
FIG. 10 is a fragmentary perspective view similar to that shown in FIGS. 3 and 6 and illustrating the visor having been tilted backward.
Figure 11:
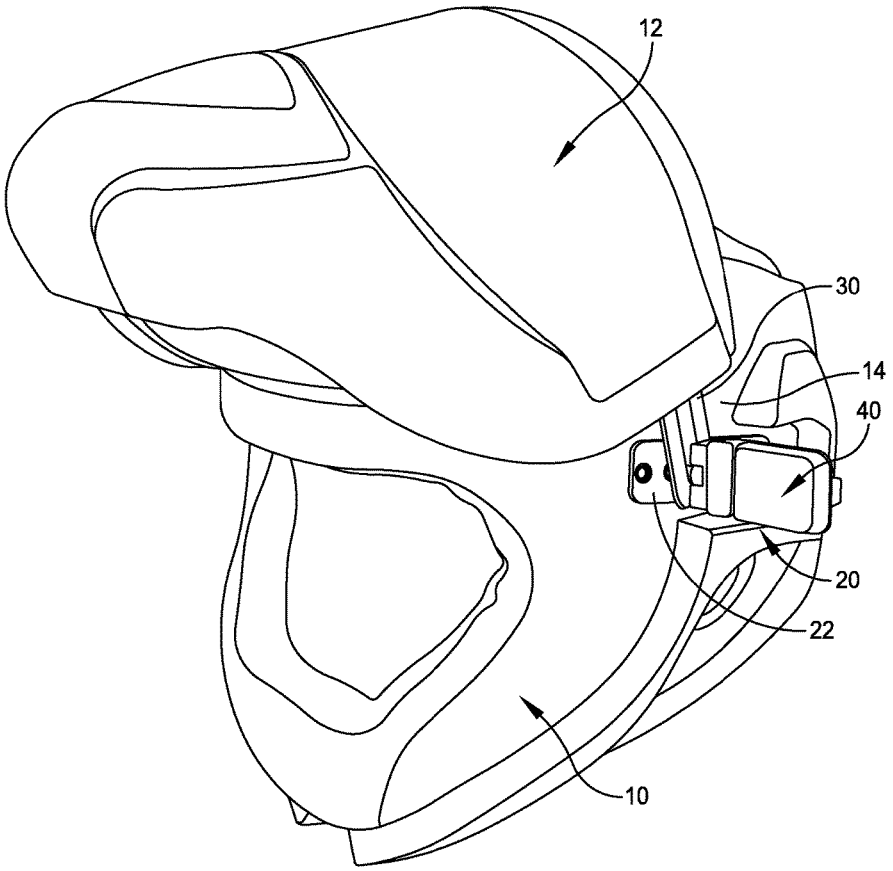
FIG. 11 is a perspective view illustrating the visor, having been moved forward, and also having been pivoted and tilted upwardly.

Reference may now be made to the cross-sectional view of FIG. 8 which illustrates a de-coupling between the sawtooth surfaces 26 and 32 to enable a sliding action of the slide plate 30. This occurs by virtue of the wearer of the helmet moving the slide plate away from the base plate, such as in the direction of arrows 72 as illustrated in FIG. 8. This sliding motion occurs while the pin 50 is still maintained in the hole 25 of the base plate 22. FIG. 9 now illustrates the next step which is the sliding of the slide plate 30 in the direction of arrow 74. This is enabled by virtue of the elongated slot 31 in the slide plate 30 that enables the slide plate to move to the position of FIG. 9 while still engaged with the pin 50. Finally, in the fragmentary enlarged perspective view of FIG. 10, the arrow 76 illustrates a pivoting of the visor to an upward position. In the position of FIG. 10, the end 47 of the pivot plate 40 at arms 44 is preferably flat so that the pivot plate 40 is essentially maintained in that position while still allowing a pivoting action in the direction of arrow 76. FIG. 11 also illustrates this pivoting action, illustrating the slide plate 30 and the pivot plate 40.

Figure 13:
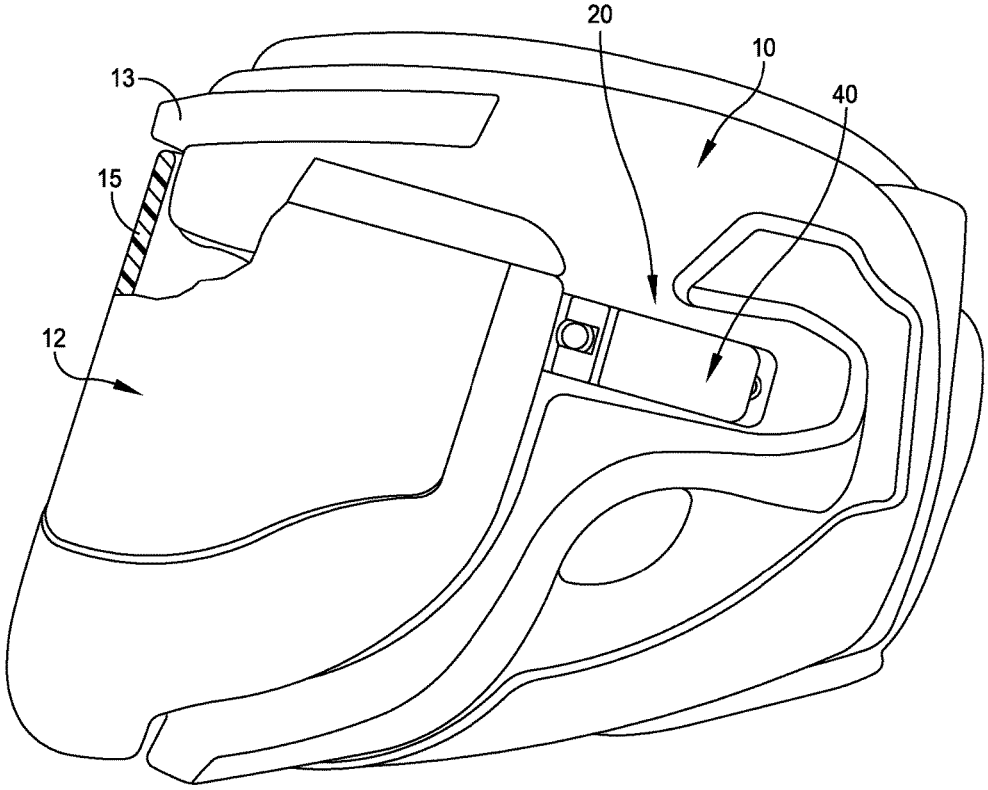
FIG. 13 is a side elevation view of the helmet with the slide assembly shown in an initial locked position.
Figure 14:
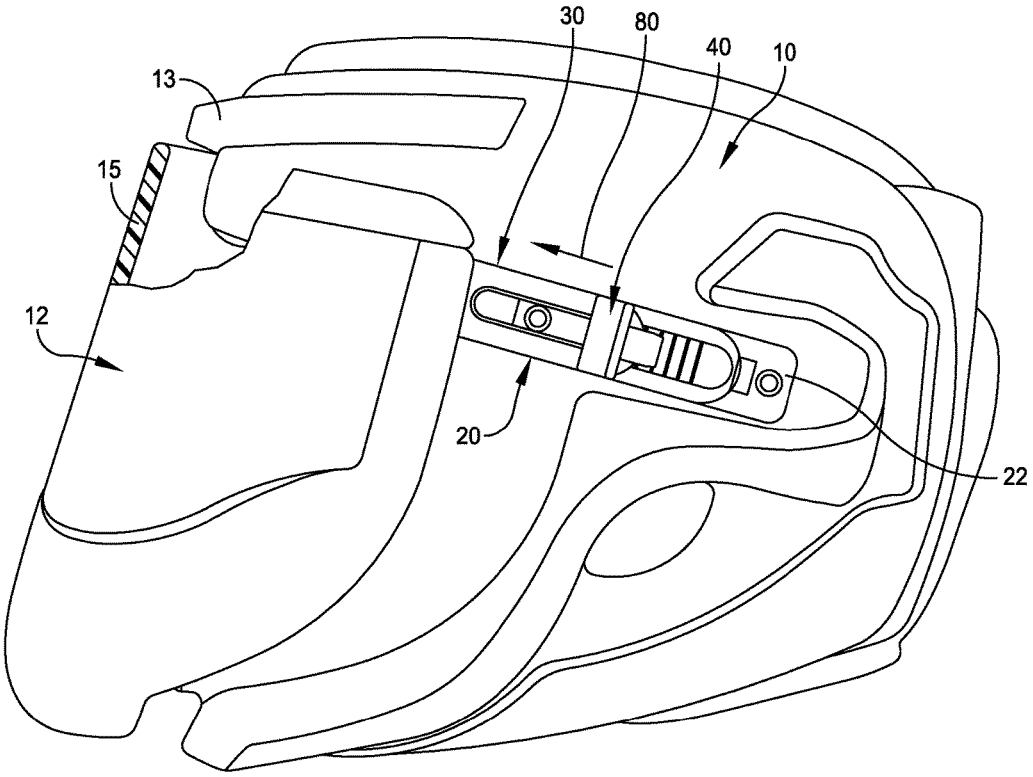
FIG. 14 is a side elevation view similar to that shown in FIG. 13 with the slide assembly having been moved forward.
Figure 15:
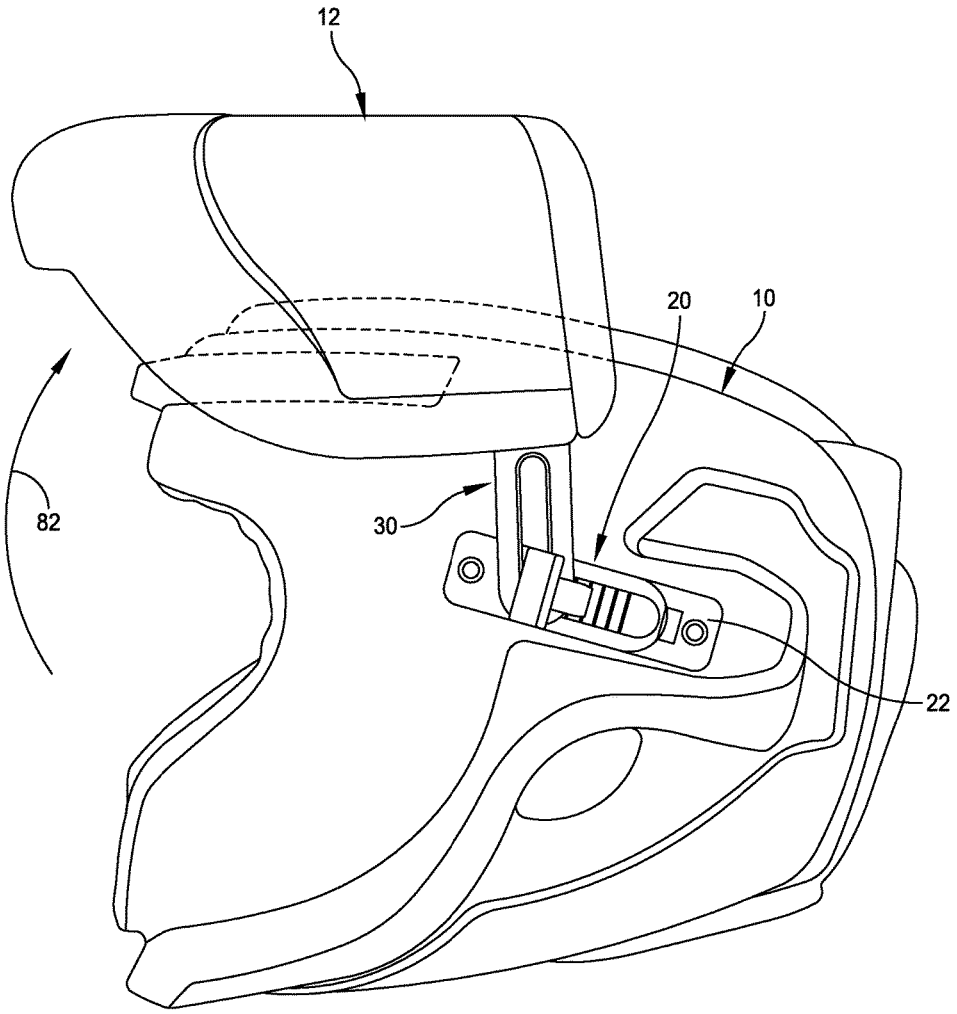
FIG. 15 is a side elevation view showing the visor pivoted or tilted upwardly.

Reference is also now made to respective side elevation views shown in FIGS. 13-15. The purpose of these views is to illustrate the manner in which the visor 12 can easily be moved forwardly and then pivoted upwardly so as to clear the cushion 13 on the helmet 10. In this regard, FIG. 13 illustrates a visor wall 15. It is noted that in the closed locked position of the visor, this wall 15 is under the cushion 13 and thus would not be able to be moved upwardly. The next side elevation view of FIG. 14 illustrates the slide member 30 being moved in the direction of arrow 80. In that position it can be seen that the visor wall 15 is clear of the arcuate cushion member 13. Finally, in the side elevation view of FIG. 15, the arrow 82 illustrates a pivoting or tilting of the visor 12 to an open position. The pivoting of FIG. 15 is essentially about the axis of the screw 50.

It is also understood that the actions described herein can readily be reversed so that the visor can be moved from the open position as illustrated in FIG. 15 to a downward position as illustrated in FIG. 14 and from there the slide member is slid in the direction opposite to the arrow 80 in FIG. 14. The sawtooth surfaces 26 and 32 can then be engaged as illustrated in the cross-sectional view of FIG. 7 and the pivot plate 40 is then pivoted to a locked position as illustrated in the cross-sectional view of FIG. 4.

As indicated previously, there is a slide assembly 20 on each side of the helmet and the actions that are described herein are meant to apply equally to both the slide assemblies so that the action taken is in concert, whether opening or closing the visor.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A helmet slide assembly attached to a helmet and functioning to enable a tilting of a visor relative to the helmet, said helmet assembly comprising:

a base plate that is attached to a sidewall of the helmet;

a slide plate disposed substantially in a parallel arrangement relative to the base plate and secured to a sidewall of the visor;

said slide plate having an elongated slot;

a pivot plate having locked and unlocked positions; and a pivot member secured at one end thereof to the pivot plate; said slide plate constructed and arranged for a sliding motion once the pivot plate is unlocked, wherein an opposite end of the pivot plate has a releasable latch for engagement with the base plate in the locked position of the pivot plate, wherein the base plate and slide plate have respective interlocking surfaces, wherein the pivot member comprises a first pivot pin that is pivotally secured at one end of the pivot plate by means of a second pivot pin that extends through a head of the first pivot pin, said pivot plate, in its locked position, extending substantially parallel to the slide plate, and, in its unlocked position extending substantially orthogonal to the slide plate, wherein the first pivot pin extends through the elongated slot in the slide plate, and the base plate also has a hole therein for accommodating an end of the first pivot pin, and wherein the base plate has a tang that is engageable with the latch in the locked position of the pivot plate.

2. The helmet slide assembly of claim 1, wherein the interlocking surfaces are a sawtooth surface.

3. The helmet slide assembly of claim 1, wherein the slide plate has an engaged position wherein the base plate and slide plate respective interlocking surfaces are interlocked, and dis-engaged position wherein the slide plate is transitioned lateral to the base plate so as to move the visor away from the helmet sidewall, enabling the visor to be tilted upwardly.

4. The helmet slide assembly of claim 1, wherein the elongated slot in the slide plate allows the slide plate to transition in a direction so that the visor moves away from the helmet, both the slide plate and base plate are substantially planar extending in a longitudinal direction, the slide plate moving in the longitudinal direction to a position wherein the pivot plate can then be pivoted to hold the visor in a forward position.

5. The helmet slide assembly of claim 4, wherein the base plate has opposed end securing means for securing the base plate to the helmet, and a center section that includes a sawtooth engagement section that partially extends longitudinally;

the slide plate has at least one hole for receiving a fastener for securing the slide plate with the visor, and a sawtooth section adjacent to the elongated slot and engageable with the sawtooth section of the base plate in the locked position; and the pivot plate has a pair of end arms, each with a hole, for receiving the second pin.

6. A helmet slide assembly attached to a helmet and functioning to enable a tilting of a visor relative to the helmet, said helmet assembly comprising:

a base plate that is attached to a sidewall of the helmet;

a slide plate disposed adjacent to the base plate, secured to a sidewall of the visor and having an elongated slot;

a pivot plate disposed adjacent to the slide plate and remote from the base plate and having locked and unlocked positions;

a pivot pin secured at one end thereof to the pivot plate, passing through the elongated slot in the slide plate and engaged with the base plate; and said slide plate constructed and arranged for a sliding motion once the pivot plate is unlocked, wherein an opposite end of the pivot plate has a releasable latch for engagement with the base plate in the locked position of the pivot plate, wherein the base plate and slide plate have respective facing interlocking surfaces, and wherein the base plate has a tang that is engageable with the latch in the locked position of the pivot plate.

7. The helmet slide assembly of claim 6, wherein the interlocking surfaces are a sawtooth surface.

8. The helmet slide assembly of claim 6, wherein the pivot pin comprises a first pivot pin and further including a second pivot pin for pivotally securing the first pivot pin to the pivot plate and that extends through a head of the first pivot pin, said pivot plate, in its locked position, extending substantially parallel to the slide plate, and, in its unlocked position extending substantially orthogonal to the slide plate.

9. The helmet slide assembly of claim 8 wherein the base plate also has a hole therein for accommodating an end of the first pivot pin.

10. The helmet slide assembly of claim 6, wherein the slide plate has an engaged position wherein the base plate and slide plate respective interlocking surfaces are interlocked, and dis-engaged position wherein the slide plate is transitioned lateral to the base plate so as to move the visor away from the helmet sidewall, enabling the visor to be tilted upwardly.

11. The helmet slide assembly of claim 10, wherein the elongated slot in the slide plate allows the slide plate to transition in a direction so that the visor moves away from the helmet, both the slide plate and base plate are substantially planar extending in a longitudinal direction, the slide plate moving in the longitudinal direction to a position wherein the pivot plate can then be pivoted to hold the visor in a forward position.

12. The helmet slide assembly of claim 11, wherein the base plate has opposed end securing means for securing the base plate to the helmet, and a center section that includes a sawtooth engagement section that partially extends longitudinally;

the slide plate has at least one hole for receiving a fastener for securing the slide plate with the visor, and a sawtooth section adjacent to the elongated slot and engageable with the sawtooth section of the base plate in the locked position; and the pivot plate has a pair of end arms, each with a hole, for receiving the second pin.

* * * * *